US005582657A

United States Patent [19]

Watanabe et al.

[11] Patent Number: 5,582,657

[45] Date of Patent: Dec. 10, 1996

[54] HEAT-RESISTANT, FERRITIC CAST STEEL HAVING HIGH CASTABILITY AND EXHAUST EQUIPMENT MEMBER MADE THEREOF

[75] Inventors: Rikizou Watanabe, Mooka; Norio Takahashi, Ohmiya; Toshio Fujita, Tokyo, all of Japan

[73] Assignee: Hitachi Metals, Ltd., Tokyo, Japan

[21] Appl. No.: 343,862

[22] Filed: Nov. 17, 1994

[30] Foreign Application Priority Data

Nov. 25, 1993 [JP] Japan ..... 5-318946

[51] Int. Cl.[6] ..... C22C 38/18

[52] U.S. Cl. ..... 148/325; 420/67; 420/69

[58] Field of Search ..... 148/325; 420/67, 420/69

[56] References Cited

U.S. PATENT DOCUMENTS

| | | | |
|---|---|---|---|
| 3,649,252 | 3/1972 | Kirkby et al. | 420/69 |
| 5,091,147 | 2/1992 | Ohtsuka et al. | 420/69 |
| 5,106,578 | 4/1992 | Ohtsuka et al. | 420/68 |
| 5,152,850 | 10/1992 | Takahashi et al. . | |

FOREIGN PATENT DOCUMENTS

| | | |
|---|---|---|
| 0359085 | 3/1990 | European Pat. Off. . |
| 0449611 | 10/1991 | European Pat. Off. . |
| 0492674 | 7/1992 | European Pat. Off. . |
| 0511648 | 11/1992 | European Pat. Off. . |
| 0530604 | 3/1993 | European Pat. Off. . |
| 533105 | 2/1993 | Japan . |
| 5-140700 | 6/1993 | Japan . |
| 369481 | 7/1963 | Switzerland . |
| 658115 | 10/1951 | United Kingdom . |
| 1205250 | 9/1970 | United Kingdom . |

OTHER PUBLICATIONS

European Search Report dated Feb. 23, 1995.

*Primary Examiner*—John Sheehan

*Attorney, Agent, or Firm*—Finnegan, Henderson, Farabow, Garrett & Dunner

[57] ABSTRACT

The heat-resistant, ferritic cast steel of a high castability has a composition consisting essentially, by weight, of C: 0.15–1.20%, C-Nb/8: 0.05–0.45%, Si: 2% or less, Mn: 2% or less, Cr: 16.0–25.0%, W and/or Mo: 1.0–5.0%, Nb: 0.40–6.0%, Ni: 0.1–2.0%, N: 0.01–0.15%, and Fe and inevitable impurities: balance. The cast steel has, in addition to a usual α-phase, an α'-phase transformed from a γ-phase and composed of an α-phase and carbides. The area ratio (α'/(α+α')) of the α'-phase is 20–70%. The heat-resistant, ferritic cast steel of a high castability is suitable for exhaust equipment members such as exhaust manifolds, turbine housings, etc.

7 Claims, 2 Drawing Sheets

HEAT-RESISTANT, FERRITIC CAST STEEL HAVING HIGH CASTABILITY AND EXHAUST EQUIPMENT MEMBER MADE THEREOF

BACKGROUND OF THE INVENTION

The present invention relates to a heat-resistant cast steel suitable for exhaust equipment members, etc. for automobile engines, and more particularly to a heat-resistant cast steel having excellent durability such as a thermal fatigue resistance, thermal deformation resistance and oxidation resistance, castability and machinability, which can be produced at a low cost, and an exhaust equipment member made of such a heat-resistant cast steel.

Conventional heat-resistant cast iron and heat-resistant cast steel have compositions shown in Table 1 as Comparative Examples. Exhaust equipment members such as exhaust manifolds, turbine housings, etc. for automobiles are exposed to extremely severe conditions at high temperatures. Therefore, as materials for such exhaust equipment members, heat-resistant cast iron such as high-Si spheroidal graphite cast iron, NI-RESIST cast iron (Ni-Cr-Cu austenite cast iron), etc. shown in Table 1, heat-resistant, ferritic cast steel disclosed in JP-A-2-175841 (U.S. Pat. No. 5,106,578) and exceptionally expensive heat-resistant, high-alloy cast steel such as austenite cast steel, etc. have been employed.

Among these conventional heat-resistant cast iron and heat-resistant cast steel, for instance, high-Si spheroidal graphite cast iron and NI-RESIST cast iron are relatively good in castability, but they are poor in durability such as a thermal fatigue resistance and an oxidation resistance. Accordingly, they cannot be used for members which may be subjected to such a high temperature as 900° C. or higher. Heat-resistant ferritic cast steel disclosed in JP-A-2-175841 is good in thermal fatigue resistance but poor in thermal deformation resistance. Also, heat-resistant, high-alloy cast steel such as heat-resistant austenite cast steel, etc. is excellent in a high-temperature strength and thermal deformation resistance at 900° C. or higher, but the high-alloy east steel is poor in a thermal fatigue resistance due to a large thermal expansion coefficient. Further, because of poor castability, the high-alloy cast steel is likely to suffer from casting defects such as shrinkage cavities and poor fluidity in casting process. In addition, because of poor machinability, the production of parts from the high-alloy cast steel is not efficient. Besides the above cast iron and cast steel, ferritic cast stainless steel has been known. However, usual ferritic cast stainless steel shows poor ductility at room temperature when its high-temperature durability is improved. Accordingly, ferritic cast stainless steel cannot be used for members which are subjected to mechanical impact, etc.

OBJECT AND SUMMARY OF THE INVENTION

Accordingly, an object of the present invention is to provide a heat-resistant, ferritic cast steel having excellent durability such as a thermal fatigue resistance, a thermal deformation resistance and an oxidation resistance, castability, machinability, etc., which can be produced at a low cost, thereby solving the above problems inherent in the conventional heat-resistant cast iron and heat-resistant cast steel.

Another object of the present invention is to provide an exhaust equipment member made of such a heat-resistant cast steel.

As a result of intense research in view of the above objects, the inventors have found that by adding proper amounts of W and/or Mo, Nb, Ni, N, etc. to a ferritic cast steel, the castability can be improved and the ferrite matrix and the crystal grain boundaries can be strengthened, and further, the transformation temperature can be elevated without deteriorating the ductility at room temperature, whereby the high-temperature strength of the cast steel can be improved. The present invention has been completed based upon this finding.

Thus, the heat-resistant, ferritic cast steel having a high castability according to the present invention has a composition consisting essentially, by weight, of:

| | |
|---|---|
| C: | 0.15–1.20%, |
| C-Nb/8: | 0.05–0.45%, |
| Si: | 2% or less, |
| Mn: | 2% or less, |
| Cr: | 16.0–25.0%, |
| W and/or Mo: | 1.0–5.0%, |
| Nb: | 0.40–6.0%, |
| Ni: | 0.1–2.0%, |
| N: | 0.01–0.15%, and |

Fe and inevitable impurities: balance, the cast steel having, in addition to a usual α-phase, a phase (hereinafter referred to as "α'-phase") transformed from a γ-phase and composed of an α-phase and carbides, and an area ratio (α'/(α+α')) of the α'-phase being 20–70%.

In the above heat-resistant, ferritic cast steel having a high castability according to the present invention, the transformation temperature from the α'-phase to the γ-phase is 900° C. or higher.

The cast steel may be subjected to an annealing treatment at a temperature lower than a (γ+α) phase region.

The exhaust equipment members, such as exhaust manifolds and turbine housings, of the present invention are made of a heat-resistant, ferritic cast steel having the composition shown above.

DETAILED DESCRIPTION OF THE INVENTION

Figure 1:
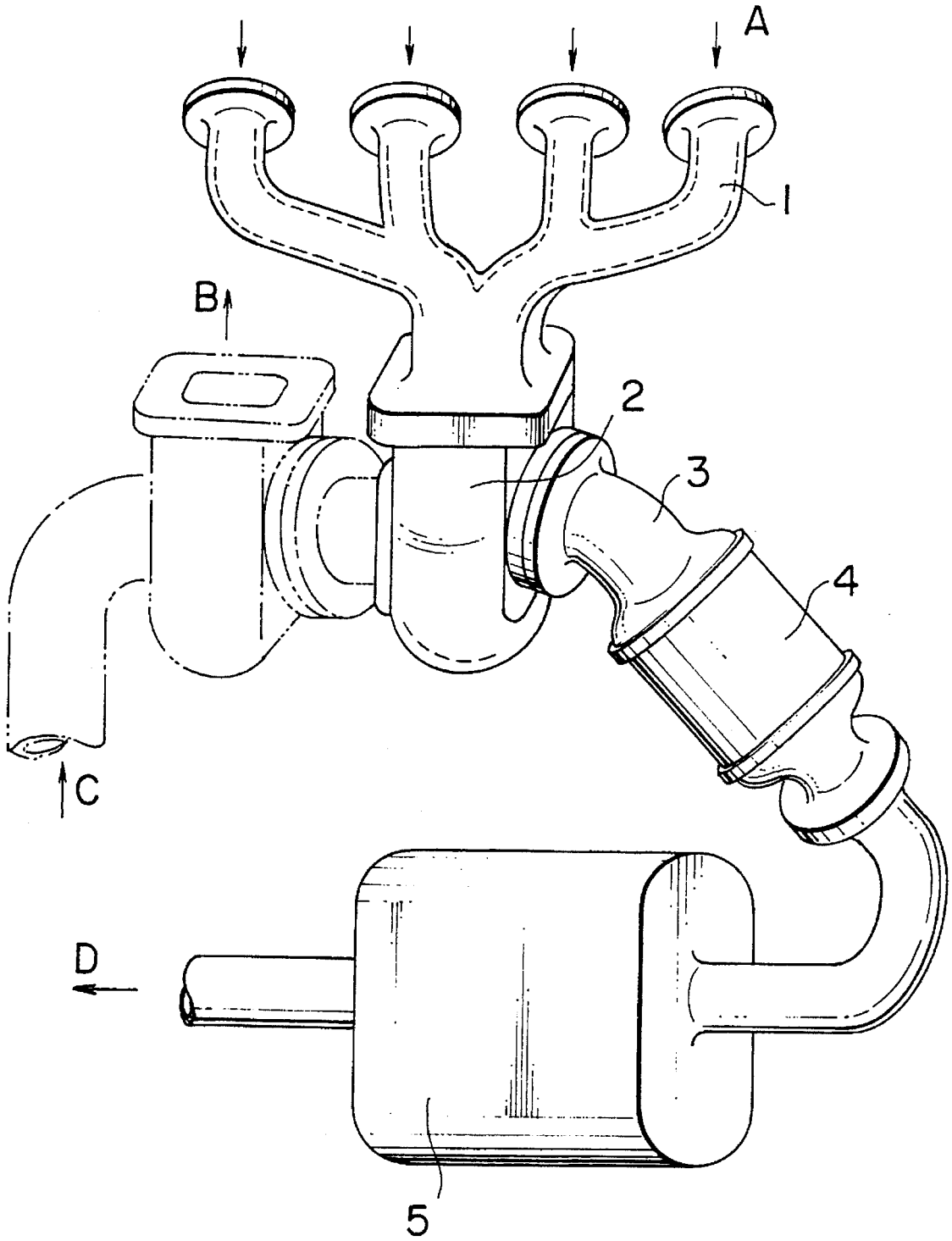
FIG. 1 is a schematic view showing exhaust equipment member (an exhaust manifold and a turbine housing) produced by the heat-resistant, ferritic cast steel having a high castability of the present invention.

The present invention will be explained in detail below.

By adding to a heat-resistant, ferritic cast steel 1.0–5.0% of W and/or Mo, 0.40–6.0% of Nb, 0.1–2.0% of Ni and 0.01–0.15% of N, each by weight ratio, the resulting metal structure comes to contain an α'-phase. The heat-resistant, ferritic cast steel containing the α'-phase shows higher thermal fatigue resistance and oxidation resistance than those of the conventional heat-resistant, high-alloy cast steel, and castability and machinability equivalent to those of the heat-resistant cast iron, without deteriorating its ductility at room temperature. Further, the addition of the above alloy elements in the above-specified weight ratios makes it possible to produce a heat-resistant cast steel at a low cost. In addition, since the transformation temperature from the α'-phase to the γ-phase of the heat-resistant, ferritic cast steel is elevated to 900° C. or higher, its thermal fatigue resistance is greatly improved.

The reasons for restricting the composition range of each alloy element in the heat-resistant, ferritic cast steel having a high castability of the present invention will be explained below.

(1) C (carbon): 0.15–1.20%

C has a function of improving the fluidity and castability of a melt and forming a proper amount of an α'-phase. C further has a function of providing the heat-resistant, ferritic cast steel with a high strength at a high temperature of 900° C. or higher. C also has a function of improving the castability by forming eutectic carbide with Nb. To exhibit such functions effectively, the amount of C should be 0.15% or more. A general heat-resistant, ferritic cast steel has only an α-phase at room temperature, but by adjusting the amount of carbon, a γ-phase in which C is dissolved is formed at a high temperature, in addition to the α-phase existing from a high temperature to room temperature. This γ-phase is transformed to (α-phase +) carbides) by precipitating carbides during the cooling process. The resulting phase (α-phase +carbides) is called "α'-phase."

On the other hand, when the amount of C exceeds 1.20%, the α'-phase is less likely to exist, thereby forming a martensite structure. Also, Cr carbides which decrease the oxidation resistance, corrosion resistance and machinability of the heat-resistant, ferritic cast steel are remarkably precipitated. Accordingly, the amount of C is 0.15–1.20%, preferably 0.2–1.0%.

(2) C-(Nb/8): 0.05–0.45%

The heat-resistant, ferritic cast steel of the present invention is provided with a high castability by forming eutectic carbides of Nb as well as a high strength and ductility by forming α'-phase transformed from γ-phase.

The weight ratio of C and Nb in eutectic carbide of Nb (NbC) is 1:8. Therefore, in order to form a proper amount of the α-phase in addition to the eutectic carbide of Nb (NbC), the amount of C should be larger than the consumed amount of C for forming the eutectic carbide. To achieve the heat-resistant, ferritic cast steel having a high castability, strength and ductility, the value of C-(Nb/8) is necessary to be 0.05% or more. When the value exceeds 0.45%, the resulting cast steel becomes hard and brittle. Accordingly, the value of C-(Nb/8) is 0.05–0.45%, preferably 0.1–0.30%.

(3) Si (silicon): 2.0% or less

Si has effects of reducing the γ-phase in the Fe-Cr alloy of the present invention, thereby increasing the stability of its metal structure and its oxidation resistance. Further, it has a function as a deoxidizer and also is effective for improving castability and reducing pin holes in the resulting cast products. However, when it is contained excessively, primary carbides grow coarser according to a balance with C (carbon equivalent), thereby deteriorating the machinability of the cast steel, and the amount of Si in the ferrite matrix becomes excessive, causing the decrease of the ductility and further causing the formation of a δ-phase at a high temperature. Accordingly, the amount of Si is 2.0% or less, preferably 0.3–1.5%.

(4) Mn (manganese): 2% or less

Mn is effective like Si as a deoxidizer for the melt, and has a function of improving the fluidity during the casting operation. To exhibit such function effectively, the amount of Mn is 2% or less, preferably 0.3–1.5%.

(5) Cr (chromium): 16.0–25.0%

Cr is an element capable of improving the oxidation resistance and stabilizing the ferrite structure of the heat-resistant, ferritic cast steel. To insure such effects, the amount of Cr should be 16.0% or more. On the other hand, if it is added excessively, coarse primary carbides of Cr are formed, and the formation of the δ-phase is accelerated at a high temperature, resulting in extreme brittleness. Accordingly, the upper limit of Cr should be 25.0%. The preferred range is 17.0–22.0%.

(6) W (tungsten) and/or Mo (molybdenum): 1.0–5.0%

W has a function of improving the high-temperature strength by strengthening the ferrite matrix without deteriorating the ductility at room temperature. Accordingly, for the purpose of improving a creep resistance and a thermal fatigue resistance due to the elevation of the transformation temperature, the amount of W should be 1.0% or more. However, when the amount of W exceeds 5.0%, coarse eutectic carbides are formed, resulting in the deterioration of the ductility and machinability. Thus, the upper limit of W is 5.0%. The preferred amount of W is 1.0–3.0%.

Substantially the same effects can be also obtained by the addition of Mo alone instead of W or the addition of Mo in combination with W in the amount described above.

(7) Nb (niobium): 0.40–6.0%

Nb forms fine carbides when combined with C, increasing the tensile strength at a high temperature and the thermal fatigue resistance. Also, by suppressing the formation of the Cr carbides, Nb functions to improve the oxidation resistance and machinability of the heat-resistant, ferritic cast steel. Further, Nb forms eutectic carbides to give a castability suitable for producing a thin cast article such as exhaust equipment member. For such purposes, the amount of Nb should be 0.40% or more. However, if they are excessively added, eutectic carbides of Nb are formed in the crystal grain boundaries to consume too much C, resulting in extreme decrease in strength and ductility. Accordingly, the upper limit of Nb should be 6.0%. The preferred amount of Nb is 0.5–3.0%.

(8) Ni (nickel): 0.1–2.0%

Ni is a γ-phase-forming element like C, and 0.1% or more of Ni is desired to form a proper amount of α'-phase. When it exceeds 2.0%, the α'-phase having an excellent oxidation resistance decreases, and the α'-phase becomes a martensite phase, leading to the remarkable deterioration of ductility. Accordingly, the upper limit of Ni should be 2.0%. The preferred amount of Ni is 0.3–1.5%.

(9) N (nitrogen): 0.01–0.15%

N is an element capable of improving the high-temperature strength and the thermal fatigue resistance like C, and such effects can be obtained when the amount of N is 0.01% or more. On the other hand, to insure the production stability and to avoid the brittleness due to the precipitation of Cr nitrides, the upper limit of N should be 0.15%. The preferred amount of N is 0.03–0.10%.

A preferred heat-resistant, ferritic cast steel having a high castability according to the present invention has a composition consisting essentially, by weight, of:

| | |
|---|---|
| C: | 0.2–1.0%, |
| C-Nb/8: | 0.1–0.30%, |
| Si: | 0.3–1.5%, |
| Mn: | 0.3–1.5%, |
| Cr: | 17.0–22.0%, |
| W and/or Mo: | 1.0–3.0%, |
| Nb: | 0.5–3.0%, |
| Ni: | 0.3–1.5%, |
| N: | 0.03–0.10%, and |
| Fe and inevitable impurities: | balance. |

(10) Area ratio of α'-phase: 20–70%

The heat-resistant, ferritic cast steel having a high castability of the present invention of the above composition has the α'-phase (α-phase and carbides) transformed from the γ-phase in addition to the usual α-phase. Incidentally, the "usual α-phase" means a δ (delta) ferrite phase. The precipitated carbides include $M_{23}C_6$, $M_7C_3$, MC, etc. wherein M represents Fe, Cr, W, Nb, etc.

When the area ratio ($\alpha'/(\alpha+\alpha')$) of this $\alpha'$-phase is lower than 20%, the heat-resistant, ferritic cast steel shows poor ductility at room temperature, so that the cast steel is extremely brittle. On the other hand, when the area ratio exceeds 70%, the cast steel becomes too hard, resulting in poor ductility at room temperature and extremely poor machinability. Accordingly, the area ratio ($\alpha'/(\alpha+\alpha')$) is 20–70%, preferably 20–60%.

The heat-resistant, ferritic cast steel is subjected after the casting process to an annealing treatment at a temperature lower than a ($\gamma+\alpha$) phase region. The annealing treatment temperature is generally 700°–850° C., and the annealing time is 1–10 hours. The above annealing temperature is in the range where the $\alpha'$-phase is not transformed to the $\gamma$-phase.

When the heat-resistant, ferritic cast steel is used in a temperature range including a transformation temperature from the $\alpha'$-phase to the $\gamma$-phase, a large thermal stress is generated by repeated heating-cooling cycles, resulting in a short duration of life due to thermal stress. Accordingly, the heat-resistant, ferritic cast steel is preferred to have a transformation temperature of 900° C. or higher. To have such a high transformation temperature, it is necessary that the ferrite-forming elements such as Cr, Si, W and/or Mo and Nb and the austenite-forming elements such as C, Ni, N and Mn are well balanced, i.e., these elements are contained in the composition described above.

Such heat-resistant, ferritic cast steel having a high castability of the present invention is particularly suitable for exhaust equipment members for automobiles. As an exhaust equipment member for automobiles, FIG. 1 shows an integral exhaust manifold mounted to a straight-type, four-cylinder engine equipped with a turbo charger. The exhaust manifold 1 is mounted to a turbine housing 2 of the turbo charger, which is connected to a catalyst converter chamber 4 for cleaning an exhaust gas via an exhaust outlet pipe 3. The converter chamber 4 is further connected to a main catalyzer 5. An outlet of the main catalyzer 5 is communicated with a muffler (not shown) in D. The turbine housing 2 is communicated with an intake manifold (not shown) in B, and an air is introduced thereinto as shown by C. The exhaust gas is introduced into the exhaust manifold 1 as shown by A.

Such exhaust manifold 1 and turbine housing 2 are desirably as thin as possible to have a small heat capacity. The thicknesses of the exhaust manifold 1 and the turbine housing 2 are, for instance, 2.5–3.4 mm and 2.7–4.1 mm, respectively.

Such thin exhaust manifold 1 and turbine housing 2 made of the heat-resistant, ferritic cast steel having a high castability show excellent durability without suffering from cracks under heating-cooling cycles.

The present invention will be explained in detail by way of the following Examples.

Examples 1–11, Comparative Examples 1–5

Y-block test pieces (No. B according to JIS) were prepared from heat-resistant, ferritic cast steels having compositions shown in Table 1. The casting was conducted by melting the steel in atmospheric air in a 100-kg high-frequency furnace, removing the resulting melt from the furnace at a temperature of 1550° C. or higher and pouring it into a mold at about 1550° C.

TABLE 1

| | Additive Component (Weight %) | | | | | |
|---|---|---|---|---|---|---|
| | C | Si | Mn | Cr | W | Mo |
| Example No. | | | | | | |
| 1 | 0.18 | 0.52 | 0.51 | 16.4 | 1.15 | — |
| 2 | 0.36 | 0.53 | 0.45 | 18.8 | 1.98 | — |
| 3 | 0.41 | 0.64 | 0.63 | 18.5 | 3.59 | — |
| 4 | 0.45 | 1.63 | 0.88 | 22.0 | 4.58 | — |
| 5 | 1.18 | 1.24 | 0.77 | 24.6 | 4.28 | — |
| 6 | 0.38 | 0.92 | 0.70 | 18.8 | 1.75 | — |
| 7 | 0.65 | 1.11 | 0.52 | 19.4 | 2.65 | — |
| 8 | 0.45 | 0.94 | 0.54 | 20.5 | 3.08 | — |
| 9 | 0.75 | 0.75 | 0.42 | 18.8 | 3.02 | — |
| 10 | 0.42 | 0.58 | 0.54 | 18.6 | — | 1.5 |
| 11 | 0.45 | 0.63 | 0.58 | 18.3 | 1.28 | 1.01 |
| Comparative Example No. | | | | | | |
| 1 | 3.33 | 4.04 | 0.35 | — | — | 0.62 |
| 2 | 2.01 | 4.82 | 0.45 | 1.91 | — | — |
| 3 | 0.28 | 1.05 | 0.44 | 17.9 | — | — |
| 4 | 0.21 | 1.24 | 0.50 | 18.8 | — | — |
| 5 | 0.12 | 1.05 | 0.48 | 18.1 | — | — |

| | Additive Component (Weight %) | | | | | Transformation |
|---|---|---|---|---|---|---|
| | Nb | Ni | N | C-(Nb/8) | $\alpha'/(\alpha+\alpha')$ (%) | Temperature (° C.) |
| Example No. | | | | | | |
| 1 | 0.51 | 0.23 | 0.04 | 0.12 | 50 | 940 |
| 2 | 1.02 | 0.65 | 0.05 | 0.23 | 45 | 960 |
| 3 | 2.15 | 0.83 | 0.03 | 0.14 | 40 | 1000 |
| 4 | 3.08 | 1.25 | 0.08 | 0.05 | 35 | 1030 |
| 5 | 5.80 | 1.75 | 0.12 | 0.45 | 30 | 1050 |
| 6 | 2.52 | 1.30 | 0.05 | 0.06 | 40 | 930 |
| 7 | 4.25 | 0.78 | 0.07 | 0.12 | 55 | 960 |
| 8 | 2.08 | 0.96 | 0.06 | 0.19 | 60 | 950 |
| 9 | 4.78 | 0.58 | 0.05 | 0.15 | 30 | 960 |
| 10 | 2.35 | 0.72 | 0.05 | 0.13 | 35 | 950 |
| 11 | 2.46 | 0.58 | 0.05 | 0.14 | 40 | 980 |
| Comparative Example No. | | | | | | |
| 1 | — | — | — | — | — | 800–850 |
| 2 | — | 35.3 | — | — | — | — |
| 3 | — | — | — | — | 93 | 910 |
| 4 | — | 9.1 | — | — | — | — |
| 5 | 1.12 | — | — | — | 0 | >1100 |

The fluidity of the heat-resistant, ferritic cast steels of Examples 1–11 was good in the process of casting, resulting in no casting defects. Next, test pieces (Y-blocks) of Examples 1–11 were subjected to a heat treatment by heating at 800° C. for 2 hours in a furnace and cooling in the air. On the other hand, the test pieces of Comparative Examples 1–5 were used in an as-cast state for the subsequent tests.

The test pieces of Comparative Examples 1–5 are those currently used for heat-resistant parts such as turbo charger housings, exhaust manifolds, etc. for automobiles. The test piece of Comparative Example 1 is high-Si spheroidal graphite cast iron, the test piece of Comparative Example 2 is NI-RESIST cast iron, the test piece of Comparative Example 3 is a CB-30 according to the ACI (Alloy Casting Institute) standards, the test piece of Comparative Example 4 is one of heat-resistant austenite cast steels (SCH 12, according to JIS), and the test piece of Comparative Example 5 is a heat-resistant, ferritic cast steel disclosed in JP-A-2-175841.

As shown in Table 1, the test pieces of Examples 1–11 show transformation temperatures higher than 900° C., and higher than those of Comparative Examples 1 and 3.

Next, the following evaluation tests on each cast test piece were conducted.

(1) Tensile test at room temperature

Conducted on a rod test piece having a gauge distance of 50 mm and a gauge diameter of 14 mm (No. 4 test piece according to JIS).

(2) Tensile test at a high temperature

Conducted on a flanged test piece having a gauge distance of 50 mm and a gauge diameter of 10 mm at 900° C.

(3) Thermal fatigue test

Using a rod test piece having a gauge distance of 20 mm and a gauge diameter of 10 mm, a heating-cooling cycle was repeated to cause thermal fatigue failure while mechanically restraining expansion and shrinkage due to heating and cooling, under the following conditions:

Lowest temperature: 100° C.

Highest temperature: 900° C.

Each 1 cycle: 12 minutes.

An electric-hydraulic servo-type thermal fatigue test machine was used for the test.

(4) Oxidation test

A rod test piece having a diameter of 10 mm and a length of 20 mm was kept in the air at 900° C. for 200 hours, and its oxide scale was removed by a shot blasting treatment to evaluate the oxidation resistance by measuring a weight loss ($mg/cm^2$) per a unit surface area.

The results of the tensile test at room temperature are shown in Table 2, and the results of the tensile test at a high temperature, the thermal fatigue test and the oxidation test are shown in Table 3.

TABLE 2

| | | At Room Temperature | | |
|---|---|---|---|---|
| | 0.2% Offset Yield Strength (MPa) | Tensile Strength (MPa) | Elongation (%) | Hardness ($H_B$) |
| Example No. | | | | |
| 1 | 380 | 515 | 8 | 197 |
| 2 | 370 | 470 | 6 | 201 |
| 3 | 355 | 450 | 4 | 197 |
| 4 | 360 | 480 | 5 | 201 |
| 5 | 330 | 440 | 3 | 192 |
| 6 | 360 | 500 | 5 | 201 |
| 7 | 370 | 490 | 3 | 217 |
| 8 | 350 | 470 | 5 | 192 |
| 9 | 340 | 450 | 5 | 197 |
| 10 | 330 | 495 | 3 | 197 |
| 11 | 350 | 500 | 5 | 197 |
| Comparative Example No. | | | | |
| 1 | 510 | 640 | 11 | 215 |
| 2 | 245 | 510 | 19 | 139 |
| 3 | 540 | 760 | 4 | 240 |
| 4 | 250 | 560 | 20 | 170 |
| 5 | 300 | 370 | 1 | 149 |

TABLE 3

| | | At 900° C. | | | |
|---|---|---|---|---|---|
| | 0.2% Offset Yield Strength (MPa) | Tensile Strength (MPa) | Elongation (%) | Thermal Fatigue Life (Cycle) | Oxidation Loss ($mg/cm_2$) |
| Example No. | | | | | |
| 1 | 20 | 35 | 48 | 186 | 3 |
| 2 | 25 | 40 | 52 | 232 | 3 |
| 3 | 27 | 42 | 48 | 390 | 2 |
| 4 | 27 | 44 | 42 | 162 | 1 |
| 5 | 25 | 38 | 44 | 338 | 1 |
| 6 | 26 | 52 | 52 | 220 | 2 |
| 7 | 25 | 50 | 50 | 205 | 1 |
| 8 | 28 | 58 | 56 | 334 | 1 |
| 9 | 26 | 55 | 42 | 280 | 1 |
| 10 | 24 | 45 | 52 | 294 | 2 |
| 11 | 26 | 55 | 56 | 284 | 2 |
| Comparative Example No. | | | | | |
| 1 | 20 | 40 | 33 | 9 | 200 |
| 2 | 40 | 90 | 44 | 23 | 20 |
| 3 | 25 | 42 | 58 | 18 | 1 |
| 4 | 65 | 128 | 31 | 35 | 2 |
| 5 | 15 | 28 | 93 | 185 | 2 |

As is clear from Tables 2 and 3, the test pieces of Examples 1–11 are extremely superior to those of Comparative Examples 1–5 in a high-temperature strength, an oxidation resistance and a thermal fatigue life. This is due to the result that the ferrite matrix was strengthened and the transformation temperature was elevated to 900° C. or higher without deteriorating the ductility at room temperature by proper amounts of W and/or Mo, Nb, Ni and N contained therein.

Also, as shown in Table 2, the test pieces of Examples 1–11 show relatively low hardness ($H_B$) of 192–217. This means that they are excellent in machinability.

Figure 2:
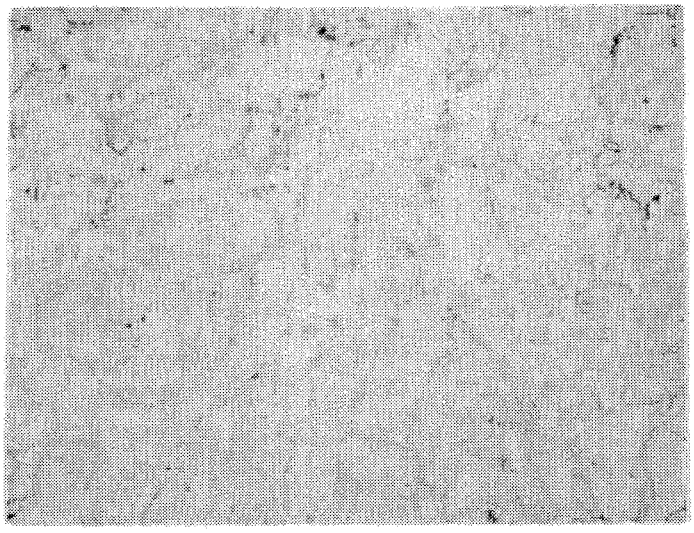
FIG. 2 is a photomicrograph (×100) showing the metal structure of the heat-resistant, ferritic cast steel having a high castability of Example 3.
Figure 3:
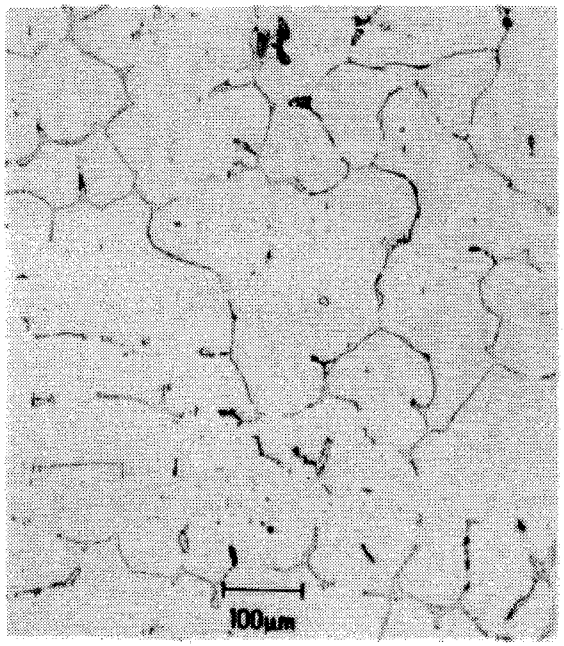
FIG. 3 is a photomicrograph (×100) showing the metal structure of the heat-resistant, ferritic cast steel of Comparative Example 5.

Photomicrographs (×100) of the heat-resistant cast steels of Example 3 and Comparative Example 5 are shown in FIGS. 2 and 3, respectively.

In FIG. 2, the grayish white portion is usual α-phase called as δ-ferrite, and the slightly grayish black portion inside the margin is transformed from γ-phase. The area ratio of α'-phase (α'/(α+α')) was 40%.

Next, an exhaust manifold (thickness: 2.5–3.4 mm) and a turbine housing (thickness: 2.7–4.1 mm) as shown in FIG. 1 were produced by casting the heat-resistant, ferritic cast steel having a high castability of Example 3. All of the resulting heat-resistant cast steel parts were free from casting defects. These cast parts were machined to evaluate their cuttability. As a result, no problem was found in any cast parts.

Next, the exhaust manifold and the turbine housing were mounted to a high-performance, straight-type, four-cylinder, 2000-cc gasoline engine (test machine) to conduct a durability test. The test was conducted by repeating 500 heating-cooling (Go-Stop) cycles, each consisting of a continuous full-load operation at 6000 rpm (14 minutes), idling (1 minute), complete stop (14 minutes) and idling (1 minute) in this order. The exhaust gas temperature under a full load operation was 930° C. at the inlet of the turbine housing. Under this condition, the highest surface temperature of the exhaust manifold was about 870° C. in a pipe-gathering portion thereof, and the highest surface temperature of the turbine housing was about 890° C. in a waist gate portion thereof. As a result of the evaluation test, no gas leak and thermal cracking due to thermal deformation were observed. It was thus confirmed that the exhaust manifold and the turbine housing made of the heat-resistant, ferritic cast steel of the present invention had excellent durability and reliability.

On the other hand, an exhaust manifold was produced from high-Si spheroidal graphite cast iron having a composition shown in Table 4, and a turbine housing was produced from austenite spheroidal graphite cast iron having a composition shown in Table 4 (NI-RESIST D2, trademark of INCO). These parts are mounted to the same engine as above, and the evaluation test was conducted under the same conditions. As a result, the exhaust manifold made of the high-Si spheroidal graphite cast iron underwent thermal cracking due to oxidation in the vicinity of the pipe-gathering portion after 98 cycles, failing to continue the operation. After that, the exhaust manifold was exchanged to that of Example 3 and the evaluation test was continued. As a result, after 324 cycles, cracking took place in a scroll portion of the turbine housing made of the austenite spheroidal graphite cast iron. The cracks were penetrating through the scroll portion. It is thus clear that the exhaust manifold and the turbine housing according to the present invention have excellent heat resistance.

TABLE 4

| Type | Chemical Component (Weight %) | | | | |
|---|---|---|---|---|---|
| | C | Si | Mn | P | S |
| High-Si Spheroidal Graphite Cast Iron | 3.15 | 3.95 | 0.47 | 0.024 | 0.008 |
| Austenite Spheroidal Graphite Cast Iron | 2.91 | 2.61 | 0.81 | 0.018 | 0.010 |

| Type | Chemical Component (Weight %) | | | |
|---|---|---|---|---|
| | Cr | Ni | Mo | Mg |
| High-Si Spheroidal Graphite Cast Iron | 0.03 | — | 0.55 | 0.048 |
| Austenite Spheroidal Graphite Cast Iron | 2.57 | 21.5 | — | 0.084 |

As described above in detail, by adding W and/or Mo, Nb, Ni and N in combination in proper amounts, the ferrite matrix and the crystal grain boundaries are strengthened, whereby the transformation temperature of the heat-resistant, ferritic cast steel is elevated without deteriorating the ductility at room temperature. As a result, the heat-resistant, ferritic cast steel of the present invention has an improved high-temperature strength. Thus, with respect to particularly important high-temperature strength, thermal fatigue resistance and oxidation resistance, the heat-resistant, ferritic cast steel of the present invention is superior to the conventional heat-resistant cast steel. In addition, since the heat-resistant, ferritic cast steel of the present invention is excellent in castability and machinability, it can be formed into cast articles at a low cost. Such heat-resistant, ferritic cast steel according to the present invention is particularly suitable for exhaust equipment members for engines, etc. The exhaust equipment members made of such heat-resistant, ferritic cast steel according to the present invention show extremely good durability without suffering from thermal cracking.

What is claimed is:

1. A heat-resistant, ferritic cast steel of a high castability, which has a composition consisting essentially, by weight, of:

| | |
|---|---|
| C: | 0.2–1.20%, |
| C—Nb/8: | 0.06–0.45%, |
| Si: | 2% or less, |
| Mn: | 2% or less, |
| Cr: | 16.0–25.0% |
| W and/or Mo: | 1.0–5.0% |
| Nb: | 1.02–6.0% |
| Ni: | 0.1–2.0% |
| N: | 0.01–0.15%, and |
| Fe and inevitable impurities: | balance, |

wherein the value of C-Nb/8 is obtained by subtracting the amount of Nb divided by 8 from the amount of C, and has an α'-phase transformed from a γ-phase in addition to a usual α-phase and composed of an α-phase and carbides, the area ratio of said α'-phase based on the total area of said '-phase and said α'-phase being 20–70%.

2. The heat-resistant, ferritic cast steel of a high castability according to claim 1, wherein a transformation temperature from said α'-phase to said γ-phase is 900° C. or higher.

3. The heat-resistant, ferritic cast steel of a high castability according to claim 1, wherein said cast steel is subjected after casting process thereof to an annealing treatment at a temperature lower than a (γ+α) phase region.

4. The heat-resistant, ferritic cast steel of a high castability according to claim 2, wherein said cast steel is subjected after casting process thereof to an annealing treatment at a temperature lower than a (γ+α) phase region.

5. An exhaust equipment member made of a heat-resistant, ferritic cast steel of a high castability, which has a composition consisting essentially, by weight, of:

| | |
|---|---|
| C: | 0.2–1.20%, |
| C—Nb/8: | 0.06–0.45%, |
| Si: | 2% or less, |
| Mn: | 2% or less, |
| Cr: | 16.0–25.0% |
| W and/or Mo: | 1.0–5.0% |
| Nb: | 1.02–6.0% |
| Ni: | 0.1–2.0% |
| N: | 0.01–0.15%, and |
| Fe and inevitable impurities: | balance, |

wherein the value of C-Nb/8 is obtained by subtracting the amount of Nb divided by 8 from the amount of C, and has an α'-phase transformed from a γ-phase in addition to a usual α-phase and composed of an α-phase and carbides, the area ratio of said α'-phase based on the total area of said α-phase and said α'-phase being 20–70%.

6. The exhaust equipment member according to claim 5, wherein said exhaust equipment member is an exhaust manifold.

7. The exhaust equipment member according to claim 5, wherein said exhaust equipment member is a turbine housing.

* * * * *

UNITED STATES PATENT AND TRADEMARK OFFICE

CERTIFICATE OF CORRECTION

PATENT NO. : 5,582,657

DATED : December 10, 1996

INVENTOR(S) : WATANABE et al.

It is certified that error appears in the above-indentified patent and that said Letters Patent is hereby corrected as shown below:

Claim 1, col 10, line 20, "'-phase (prime -phase) should read --α'-phase-- (alpha prime-phase).

Signed and Sealed this

Twenty-fifth Day of February, 1997

*Attest:*

*Attesting Officer*

BRUCE LEHMAN

*Commissioner of Patents and Trademarks*